United States Patent [19]

Seal

[11] Patent Number: 4,683,400

[45] Date of Patent: Jul. 28, 1987

[54] TRAVELLING WAVE TUBE AND HELIX FOR SUCH TRAVELLING WAVE TUBE

[75] Inventor: Michael Seal, Amsterdam, Netherlands

[73] Assignee: D. Drukker & Zn. N.V., Amsterdam, Netherlands

[21] Appl. No.: 791,313

[22] Filed: Oct. 25, 1985

[30] Foreign Application Priority Data

Oct. 31, 1984 [NL] Netherlands ..... 8403311

[51] Int. Cl.[4] ..... H01J 25/34

[52] U.S. Cl. ..... 315/3.5; 315/3.6

[58] Field of Search ..... 315/3.5, 3.6

[56] References Cited

U.S. PATENT DOCUMENTS

| | | | |
|---|---|---|---|
| 4,115,721 | 9/1978 | Friz | 315/3.5 |
| 4,278,914 | 7/1981 | Harper | 315/3.5 |
| 4,347,419 | 8/1982 | Jasper | 315/3.5 |
| 4,459,562 | 7/1984 | Kosmahi | 315/3.6 |

*Primary Examiner*—Harold Dixon

*Attorney, Agent, or Firm*—Kane, Dalsimer, Kane, Sullivan and Kurucz

[57] ABSTRACT

A travelling wave tube comprising a tube and a helix mounted in the tube, the helix being made of diamond and being coated at least partially with an electrically conductive material.

3 Claims, 4 Drawing Figures

TRAVELLING WAVE TUBE AND HELIX FOR SUCH TRAVELLING WAVE TUBE

The invention relates to a travelling wave tube comprising a tube and a helix mounted in said tube.

At the known travelling wave tube the helix usually consists of copper, copper-coated tungsten or molybdenum. Said helix is mounted in the tube by means of supporting blocks which for example consist of diamond. The diamond supporting blocks are used to provide for a good discharge of the dissipated heat. During operation very high temperatures will occur in the helix, wherein in particular the temperatures in the helix at the output side of the tube can reach very high values. By this non-uniform distribution of the temperature along the helix the operation of the tube could be adversely effected by the varying temperature, whereas the maximum allowable power output of the tube is restricted.

An object of the invention is to provide a travelling wave tube of the above-mentioned kind wherein said disadvantages are obviated in a simple but nevertheless effective manner.

A further object of the invention is to provide a travelling wave tube adapted to provide a relatively high power output.

According to the invention the travelling wave tube is provided with a helix made of diamond and coated at least partially with an electrically conductive material.

In this manner a very good conduction of the heat in axial direction of the helix is obtained so that the temperature shows a minimum gradient along the length of the helix. The heat especially dissipated at the output side of the travelling wave tube is distributed along the whole length of the helix so that a higher power output is allowable.

The helix according to the invention is made of a diamond rod, the required helix shape being cut by means of a laser beam. Thereby the advantage is obtained that the pitch of the helix can be varied within a large range. This in contrast to the helix of the known travelling wave tubes wherein the helix is bent of a tape whereby restrictions for the pitch of the helix are met.

According to a preferred embodiment said helix is directly connected to the inner wall of the tube, only a part of the helix, which is not in electrical contact with the inner wall of the tube, being coated with the electrically conductive material. Thereby no supporting blocks are necessary so that manufacturing is simplified. Moreover the helix contacts the tube along its whole length and periphery whereby the heat discharge to the tube which is cooled at the outer side, is very good.

The invention also provides a helix to be mounted in a travelling wave tube, said helix being coated at least partially with an electrically conductive material.

The invention will hereinafter be explained by reference to the drawings in which two embodiments are shown.

Figure 2:
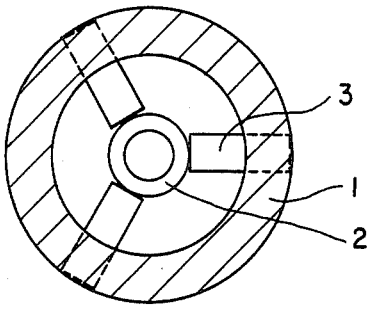
FIG. 2 shows a cross section of the travelling wave tube according to the line II—II in FIG. 1.
Figure 1:
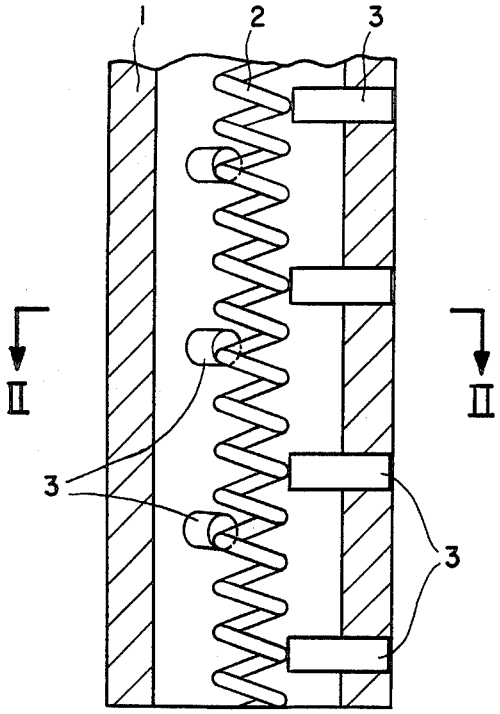
FIG. 1 is a longitudinal section of a part of a travelling wave tube according to the invention.

FIG. 1 shows a part of a travelling wave tube comprising a closed tube 1 and a helix 2 mounted in the tube 1. At the embodiment shown in FIG. 1 the helix 2 is supported in the tube 1 by means of supporting blocks 3. These supporting blocks 3 consisting of diamond are regularly distributed along the length and the periphery of the helix 2 as also can be seen in FIG. 2. The supporting blocks provide a good electrical insulation between the helix 2 and the tube 1 whereas a good heat transfer from the helix to the tube is also provided.

This heat transfer is of great importance as during operation high temperatures occur in the helix 2, in particular at the output side of the travelling wave tube. As only the tube 1 can be cooled at the outer side, a good heat transfer is of importance. The problem herein arises that the temperatures especially at the output side of the travelling wave tube can become very high.

At the travelling wave tube of the invention this problem is obviated in that the helix 2 consists of diamond which is partially coated with an electrically conductive material. The helix 2 preferably consists of diamond of type 2A. Because the helix consists of a material with good heat-conducting properties, a heat conduction in axial direction occurs so that the heat especially dissipated at the output side is uniformly distributed along the helix 2 whereby a higher power output is allowable.

Figure 4:
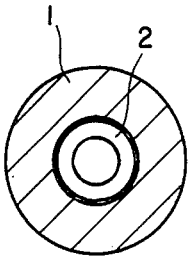
FIG. 4 shows a cross section of the travelling wave tube of FIG. 3 according to the line IV—IV.
Figure 3:
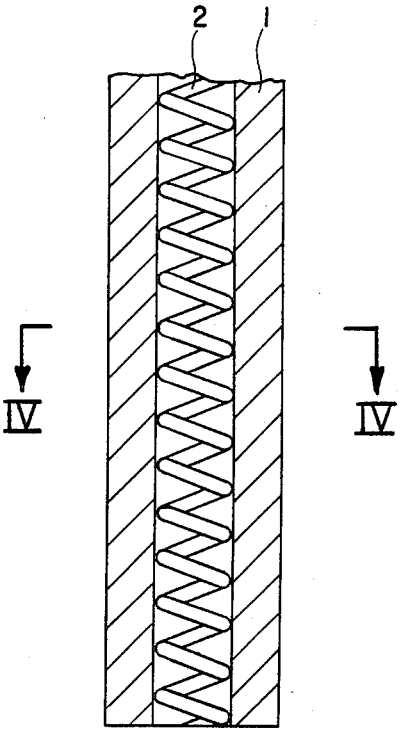
FIG. 3 shows a longitudinal section of a preferred embodiment of the travelling wave tube according to the invention.

Because the material of the helix is electrically non-conductive, the helix 2 can be connected directly to the inner wall of the tube 1 as shown in FIGS. 3 and 4. Of course, only the part of the helix which does not contact the inner wall of the tube 1 should be coated with the electrically conductive material. This embodiment of the travelling wave tube can be manufactured in a simple manner whereas the heat transfer from the helix 2 to the tube 1 is optimum.

The manufacturing of the helix 2 of diamond can take place by providing a rod with the required helix shape by means of a laser beam. Thereby the advantage is obtained that the pitch of the helix can be chosen within a large range.

The invention is not restricted to the above-described embodiments which can be varied within the scope of the claims in various ways.

I claim:

1. Travelling wave tube comprising a tube, and a helix mounted in said tube, said helix being made of diamond and being coated at least partially with an electrically conductive material.

2. Travelling wave tube according to claim 1, wherein said helix is directly connected to the inner wall of the tube, only that part of the helix, which is not in electrical contact with the inner wall of the tube, being coated with the electrically conductive material.

3. Helix to be mounted in a travelling wave tube according to claim 1, said helix being coated at least partially with an electrically conductive material.

* * * * *